US009407046B1

(12) United States Patent
Bucher

(10) Patent No.: US 9,407,046 B1
(45) Date of Patent: Aug. 2, 2016

(54) ELECTRICAL CONNECTOR ASSEMBLY

(71) Applicant: Tyco Electronics Corporation, Berwyn, PA (US)

(72) Inventor: Alan Weir Bucher, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/713,697

(22) Filed: May 15, 2015

(51) Int. Cl.
*H01R 13/648* (2006.01)
*H01R 13/659* (2011.01)

(52) U.S. Cl.
CPC ..... *H01R 13/659* (2013.01)

(58) Field of Classification Search
CPC ..... H01R 13/65802; H01R 23/6873; H01R 13/659; H01R 13/6581; H01R 12/7076; H01R 13/665
See application file for complete search history.

(56) References Cited

U.S. PATENT DOCUMENTS 7,488,212 B2 * 2/2009 Chen ..... G02B 6/4277 361/800
9,112,314 B2 * 8/2015 Khazen ..... H01R 13/65802
9,124,205 B2 * 9/2015 Lee ..... H02P 6/182

* cited by examiner

*Primary Examiner* — Xuong Chung Trans

(57) ABSTRACT

An electrical connector assembly includes a cage member having a plurality of walls defining an upper port and a lower port for pluggable modules. The walls define side walls along sides of the upper and lower ports. The walls are manufactured from a metal material and providing electrical shielding for the upper port and the lower port. The walls define a port separator extending between the side walls below at least one of the upper port and the lower port. The port separator has an upper plate and a lower plate extending between the side walls of the cage member. The port separator has a plurality of channel walls extending between the upper plate and the lower plate to divide the port separator into a plurality of channels. The channels are open at a front and a rear of the port separator to direct airflow through the port separator.

20 Claims, 3 Drawing Sheets

ELECTRICAL CONNECTOR ASSEMBLY

BACKGROUND OF THE INVENTION

The subject matter herein relates generally to electrical connector assemblies for high speed fiber optical and copper communications.

It is known to provide a metal cage with a plurality of ports, whereby transceiver modules are pluggable therein. Several pluggable module designs and standards have been introduced in which a pluggable module plugs into a receptacle which is electronically connected to a host circuit board. For example, a well-known type of transceiver developed by an industry consortium is known as a gigabit interface converter (GBIC) or serial optical converter (SOC) and provides an interface between a computer and a data communication network such as Ethernet or a fiber network. These standards offer a generally robust design which has been well received in industry.

It is desirable to increase the operating frequency of the network connections. Electrical connector systems that are used at increased operating speeds present a number of design problems, particularly in applications in which data transmission rates are high, e.g., in the range above 10 Gbps (Gigabits/second). One concern with such systems is reducing electromagnetic interference (EMI) emissions. Another concern is reducing operating temperatures of the transceivers.

In conventional designs, thermal cooling is achieved by using a heat sink and/or airflow over the shielding metal cage surrounding the receptacles. However, the thermal cooling provided by conventional designs is proving to be inadequate, particularly for the transceivers in the lower row of a stacked configuration.

BRIEF DESCRIPTION OF THE INVENTION

In one embodiment, an electrical connector assembly is provided including a cage member having a plurality of walls defining an upper port and a lower port configured to receive pluggable modules therein. The walls define side walls along sides of the upper and lower ports. The walls are manufactured from a metal material and provide electrical shielding for the upper port and the lower port. The walls define a port separator extending between the side walls below at least one of the upper port and the lower port. The port separator has an upper plate and a lower plate extending between the side walls of the cage member. The port separator has a plurality of channel walls extending between the upper plate and the lower plate to divide the port separator into a plurality of channels. The channels are open at a front and a rear of the port separator to direct airflow through the port separator.

In a further embodiment, an electrical connector assembly is provided including a cage member having a plurality of walls defining an upper port and a lower port configured to receive pluggable modules therein. The walls define side walls along sides of the upper and lower ports. The walls are manufactured from a metal material and provide electrical shielding for the upper port and the lower port. The walls define a lower port separator extending between the side walls below the lower port. The lower port separator has an upper plate and a lower plate extending between the side walls of the cage member. The lower port separator has a plurality of channel walls extending between the upper plate and the lower plate to divide the lower port separator into a plurality of channels. The channels are open at a front and a rear of the lower port separator to direct airflow through the lower port separator. The walls define an upper port separator extending between the side walls between the upper port and the lower port. The upper port separator has an upper plate and a lower plate extending between the side walls of the cage member. The upper port separator has a plurality of channel walls extending between the upper plate and the lower plate to divide the upper port separator into a plurality of channels. The channels are open at a front and a rear of the upper port separator to direct airflow through the upper port separator.

In a further embodiment, an electrical connector assembly is provided including a cage member having a plurality of walls defining an upper port and a lower port configured to receive pluggable modules therein through a front end of the cage member. The walls define side walls along sides of the upper and lower ports. The walls are manufactured from a metal material and provide electrical shielding for the upper port and the lower port. A communication connector is disposed within the cage member at a rear end of the cage member and positioned to mate with the pluggable modules when the pluggable modules are inserted into the upper and lower ports. The walls define a port separator extending between the side walls below at least one of the upper port and the lower port. The port separator has an upper plate and a lower plate extending between the side walls of the cage member. The port separator has a plurality of channel walls extending between the upper plate and the lower plate to divide the port separator into a plurality of channels. The channels are open at the front end and the rear end of the cage member to direct airflow through the cage member. Portions of the channels pass between the communication connector and the corresponding side walls. The walls define port flanks extending between the side walls and the corresponding upper port or the lower port. Each port flank has a plurality of channel walls dividing the port flank into a plurality of channels being open at the front end and the rear end of the cage member to direct airflow through the cage member with portions of the channels passing between the communication connector and the corresponding side walls.

DETAILED DESCRIPTION OF THE INVENTION

Figure 1:
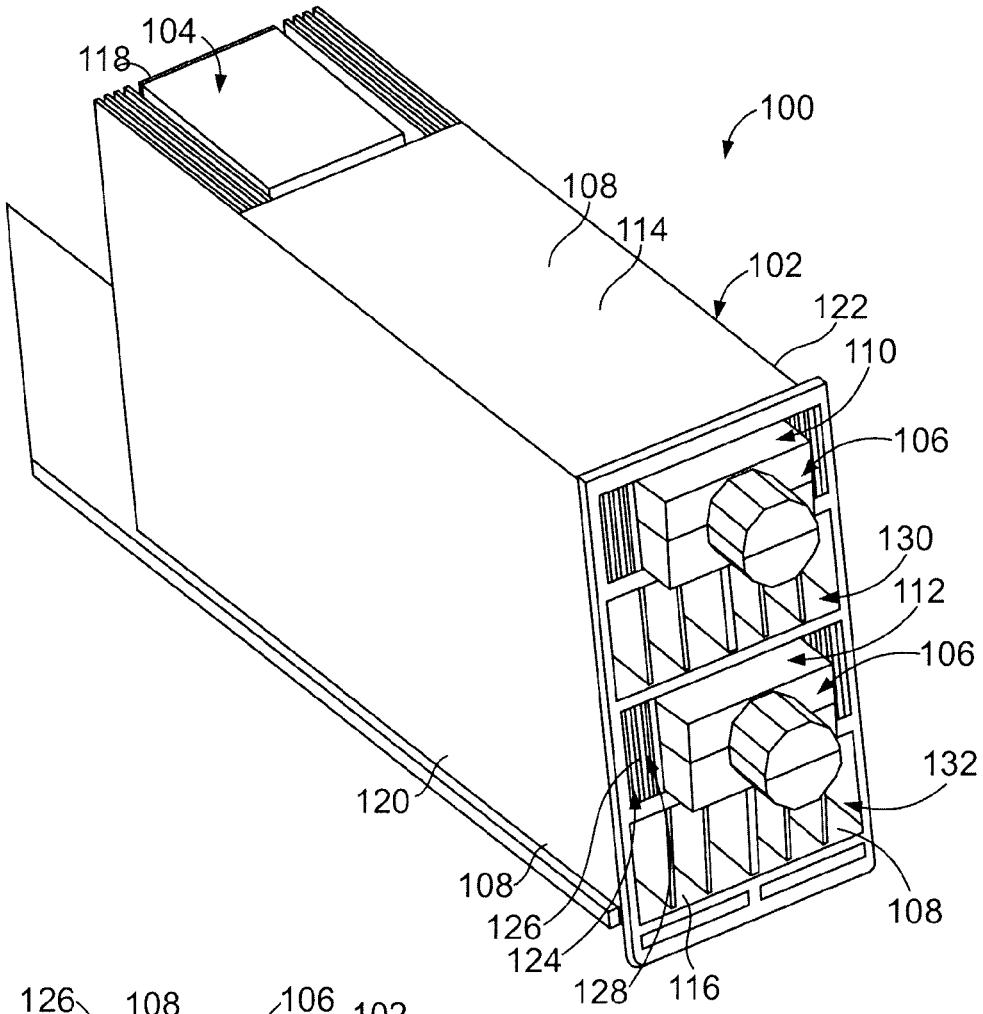
FIG. 1 is a front perspective view of an electrical connector assembly formed in accordance with an exemplary embodiment.

FIG. 1 is a front perspective view of an electrical connector assembly 100 formed in accordance with an exemplary embodiment. The electrical connector assembly 100 includes a cage member 102 and a communication connector 104 received in the cage member 102. Pluggable modules 106 are configured to be loaded into the cage member 102 for mating with the communication connector 104. The communication connector 104 is intended for placement on a circuit board, such as a motherboard, and is arranged within the cage member 102 for mating engagement with the pluggable modules 106.

The cage member 102 is a shielding, stamped and formed cage member that includes a plurality of shield walls 108 that define multiple ports 110, 112 for receipt of the pluggable modules 106. In the illustrated embodiment, the cage member 102 constitutes a stacked cage member having the ports 110, 112 in a stacked configuration. The port 110 defines an upper port positioned above the port 112 and may be referred to hereinafter as upper port 110. The port 112 defines a lower port positioned below the port 110 and may be referred to hereinafter as lower port 112. Any number of ports may be provided in alternative embodiments. In the illustrated embodiment, the cage member 102 includes the ports 110, 112 arranged in a single column, however, the cage member 102 may include multiple columns of ports 110, 112 in alternative embodiments (for example, 2×2, 3×2, 4×2, 4×3, etc.). In other alternative embodiments, the cage member 102 may include a single port or may include ports arranged in a single row (for example, non-stacked).

The cage member 102 includes a top wall 114, a lower wall 116, a rear wall 118 and side walls 120, 122, which together define the general enclosure or outer perimeter for the cage member 102. Optionally, at least a portion of the lower wall 116 may be open to allow the communication connector 104 to interface with the circuit board. In an exemplary embodiment, the shield walls 108 may include a plurality of airflow openings or channels to allow airflow therethrough, such as from front to back, back to front and/or side to side. The airflow openings help cool the shield walls 108, the ports 110, 112 and/or the pluggable modules 106. The airflow openings may have any size and shape. In an exemplary embodiment, the size, shape, spacing and/or positioning of the airflow openings may be selected with consideration to thermal performance, shielding performance (e.g. electromagnetic interference (EMI) shielding), electrical performance, or other design considerations.

In an exemplary embodiment, the cage member 102 includes port flanks 124 on opposite sides of the ports 110, 112. The port flanks 124 are positioned between the ports 110, 112 and the corresponding side walls 120, 122. The port flanks 124 have openings or channels 126 defined by channel walls 128 that define thermal vents through the cage member 102 to allow airflow entirely through the cage member 102. The port flanks 124 provide airflow through the cage member 102 for cooling the components of the electrical connector assembly 100. For example, the airflow through the port flanks 124 may cool the walls 108 defining the port flanks 124 and/or the ports 110, 112, which may transfer heat from the pluggable modules 106 and/or the communication connector 104.

The cage member 102 is subdivided by one or more port separators 130, 132. The port separators 130, 132 extend along the ports 110, 112 (for example, either above the corresponding port 110, 112 or below the corresponding port 110, 112). In the illustrated embodiment, the cage member 102 includes an upper port separator 130 below the upper port 110 and a lower port separator 132 below the lower port 112. The upper port separator 130 is positioned between the upper and lower ports 110, 112 such that the upper port separator 130 defines a lower portion of the upper port 110 and an upper portion of the lower port 112. The lower port separator 132 is positioned between the lower port 112 and the circuit board. The port separators 130, 132 are open to allow airflow through the cage member 102. The cage member 102 may include any number of port separators in alternative embodiments, including a single port separator. In various embodiments, a port separator (not shown) may be provided above the upper port 110. The channels or openings defined by the port separators 130, 132 define thermal vents through the cage member 102 to allow airflow entirely through the cage member 102. The port separators 130, 132 provide pathways for airflow through the cage member 102 for cooling the components of the electrical connector assembly 100, such as by convection. For example, the airflow through the port separators 130, 132 may cool the walls 108 defining the port separators 130, 132 and/or the ports 110, 112, which may transfer heat from the pluggable modules 106 and/or the communication connector 104.

Figure 2:
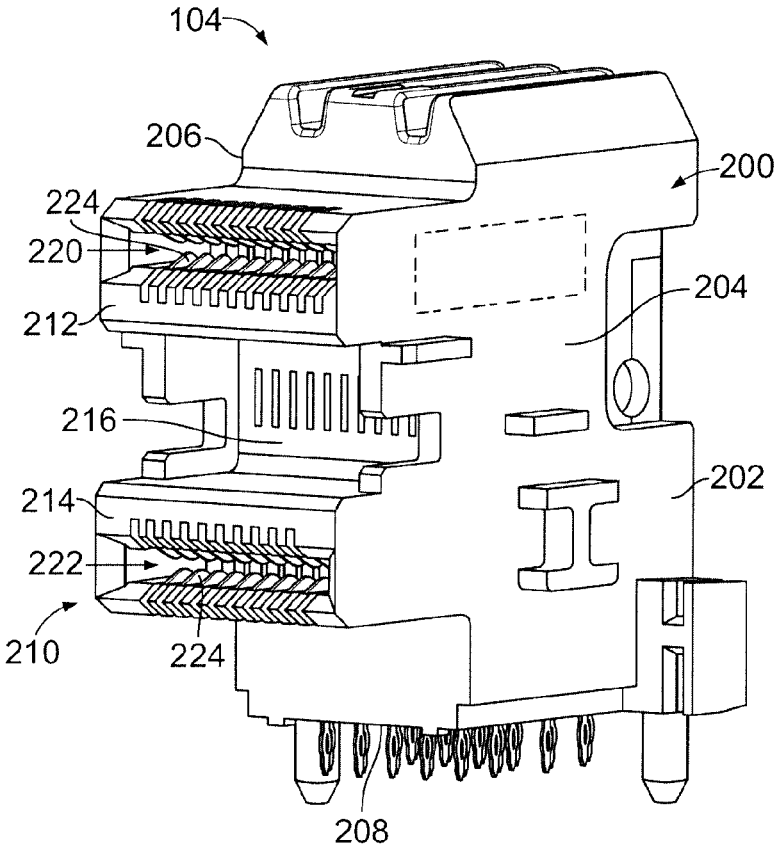
FIG. 2 is a front perspective view of a communication connector of the electrical connector assembly shown in FIG. 1.

FIG. 2 is a front perspective view of the communication connector 104. The communication connector 104 includes a housing 200 defined by an upstanding body portion 202 having sides 204, 206, a lower face 208 configured to be mounted to the motherboard, and a mating face 210. Upper and lower extension portions 212 and 214 extend from the body portion 202 to define the mating face 210. A recessed face 216 is defined between the upper and lower extension portions 212, 214 at the front face of the body portion 202.

Circuit card receiving slots 220 and 222 extend inwardly from the mating face 210 of each of the respective upper and lower extension portions 212, 214, and extend inwardly to the body portion 202. The circuit card receiving slots 220, 222 are configured to receive a card edge of the pluggable module 106 (shown in FIG. 3). A plurality of contacts 224 are held by the housing 200 and are exposed within the circuit card receiving slots 220, 222 for mating with the corresponding pluggable module 106. The contacts 224 extend from the lower face 208 for termination to the motherboard. For example, the ends of the contacts 224 may constitute pins that are loaded into plated vias of the motherboard. Alternatively, the contacts 224 may be terminated to the motherboard in another manner, such as by surface mounting to the motherboard.

Figure 3:
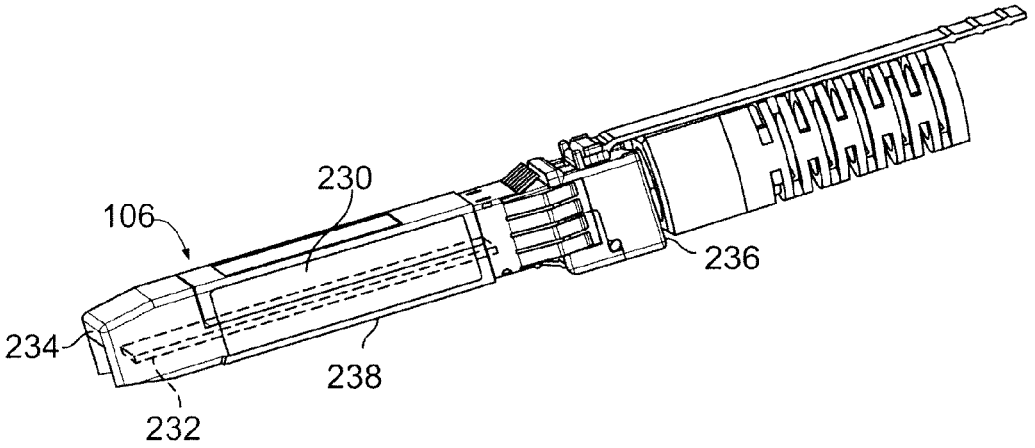
FIG. 3 illustrates an exemplary embodiment of a pluggable module for use with electrical connector assembly shown in FIG. 1.

FIG. 3 illustrates an exemplary embodiment of the pluggable module 106 for use with electrical connector assembly 100 (shown in FIG. 1). In the illustrated embodiment, the pluggable module 106 constitutes a small form-factor pluggable (SFP) module; however other types of pluggable modules or transceivers may be used in alternative embodiments. The pluggable module 106 includes a metal body or shell 230 holding a circuit card 232 at a mating end 234 thereof for interconnection into one of the slots 220 or 222 (shown in FIG. 2). The pluggable module 106 would further include an electrical interconnection within the module to an interface at end 236, such as a copper interface in the way of a modular jack, or to a fiber optic connector for further interfacing. The pluggable module 106 may include thermal interface features 238 configured to provide a thermal interface with the cage member 102 (shown in FIG. 1), such as for direct thermal contact or communication with the corresponding port separator 130, 132 (shown in FIG. 1). The thermal interface features 238 may be fins extending from the shell 230. The pluggable module may include a latching feature for securing the pluggable module 106 in the cage member 102. The latching feature may be releasable for extraction of the pluggable module 106. Other types of pluggable modules or transceivers may be utilized in alternative embodiments.

Figure 4:
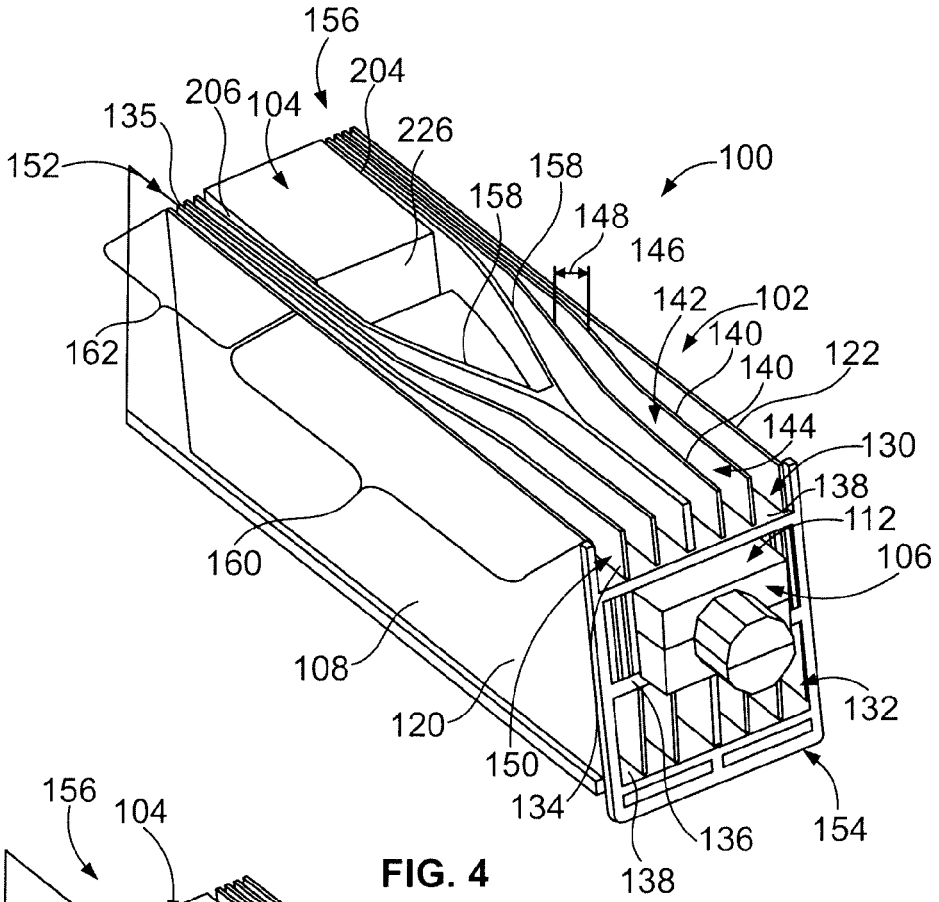
FIG. 4 is a partial sectional view of the electrical connector assembly showing a port separator thereof.

FIG. 4 is a partial sectional view of the electrical connector assembly 100 taken through the upper port separator 130; however the lower port separator 132 may include similar or identical features and like reference numerals may be used to reference like components thereof. The port separator 130 is defined by the walls 108 of the cage member 102. The port separator 130 extends between a front 134 and a rear 135. The port separator 130 has an upper plate 136 (shown in FIG. 6, the upper plate 136 of the lower port separator 132 is shown in FIG. 4) and a lower plate 138 extending between the side walls 120, 122. The upper and lower plates 136, 138 are spaced apart from one another defining an air gap therebetween that allows airflow through the cage member 102 between the front 134 and the rear 135. The upper and lower plates 136 may define portions of the corresponding ports 110, 112.

The port separator 130 has a plurality of channel walls 140 extending between the upper plate 136 and the lower plate 138 to divide the port separator 130 into a plurality of channels 142. In an exemplary embodiment, the channel walls 140 are oriented vertically; however the channels walls 140 may be oriented at other orientations, including horizontally, in alternative embodiments. In an exemplary embodiment, the channel walls 140 are interior of the walls 108 of the cage member 102. As such, the channels 142 are interior of the cage member 102. The channels 142 are open at the front 134 and the rear 135 of the port separator 130 to direct airflow through the port separator 130. The channel walls 140 divide the air gap of the port separator 130 into the individual channels 142. Optionally, the channel walls 140 may extend the entire length between the front 134 and the rear 135 of the port separator 130. Alternatively, any or all of the channel walls 140 may extend only partially between the front 134 and the rear 135. The channel walls 140 may be recessed inward from the front 134 and/or from the rear 135. Optionally, the channels 142 may have variable widths 144 along lengths thereof defined between the front 134 and the rear 135 of the port separator 130. For example, in the illustrated embodiment, portions of the channel walls 140 near the front 134 and near the rear 135 are oriented parallel to the side walls 120, 122, but the channel walls 140 include convergent sections 146 that change spacings 148 between the channel walls 140. As such, the channels 142 may be wider at the front 134 and narrower at the rear 135. Other arrangements are possible in alternative embodiments. Having variable width channels 142 may affect flow rate of the airflow in the channels 142.

In an exemplary embodiment, each of the channels 142 has an air inlet 150 and an air outlet 152. The airflow system may be set up such that the air flows from the front of the cage member 102 to the rear of the cage member 102. In such embodiments, the air inlets 150 are provided at a front end 154 of the cage member 102 while the air outlets 152 are provided at a rear end 156 of the cage member 102. However, the airflow system may be set up such that the air flows in the opposite direction from the rear end 156 of the cage member 102 to the front end 154 of the cage member 102. Optionally, the cage member 102 may have EMI reducers at the air inlet 150 and/or the air outlet 152. For example, the cage member 102 may include cross members that span across the channels 142 to reduce the size of the openings at the air inlet 150 and/or the air outlet 152.

The communication connector 104 is disposed within the cage member 102 at the rear end 156 of the cage member 102 and positioned to mate with the pluggable modules 106 when the pluggable modules 106 are inserted into the ports 110 (shown in FIG. 1), 112. In an exemplary embodiment, portions of the channels 142 pass between the communication connector 104 and the corresponding side walls 120, 122. Optionally, multiple channels 142 pass between the communication connector 104 and each side wall 120, 122. Optionally, at least one of the channel walls 140 defines a diverter wall 158 to divert the airflow from a front 226 of the communication connector 104 to the corresponding side 204, 206 of the communication connector 104 or vice versa. The diverter walls 158 ensure that the airflow does not flow into the front 226 of the communication connector 104, which would cause a pressure loss in the airflow. The channel walls 140 transition the airflow from the center of the port separator 130 to the outer sides of the port separator 130 (for example, the small space between the communication connector 104 and the side walls 120, 122) to allow the airflow to bypass the communication connector 104. The airflow flows along the sides 204, 206 and is expelled at the rear end 156. The channel walls 140 provide smooth transitions for the airflow to reduce flow resistance.

The channel walls 140 have module segments 160 near the front 134 of the port separator 130 and connector segments 162 near the rear 135 of the port separator 130. The convergent sections 146 may transition between the module segments 160 and the connector segments 162. The convergent sections 146 may form part of the module segments 160 and/or part of the connector segments 162. The module segments 160 are generally aligned (for example, aligned front to back) with the pluggable module 106 while the connector segments 162 are generally aligned (for example, aligned front to back) with the communication connector 104. The spacing 148 between the module segments 160 may be wider than the spacing 148 between the connector segments 162 as the connector segments 162 must pass through the small space between the communication connector 104 and the side walls 120, 122.

Figure 5:
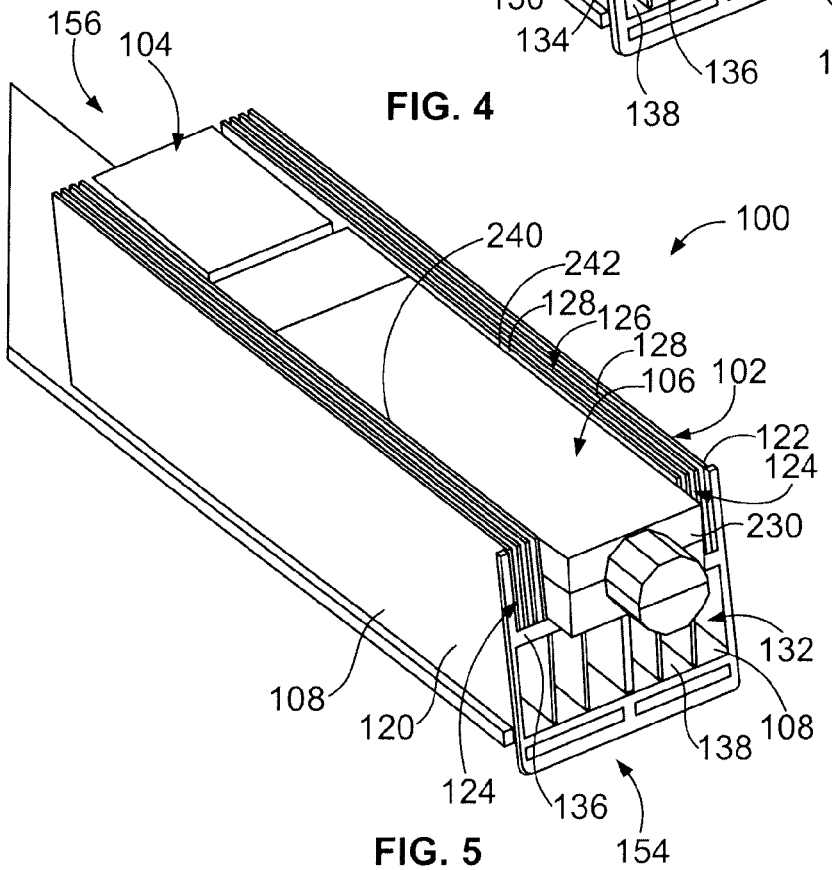
FIG. 5 is a partial sectional view of the electrical connector assembly showing port flanks thereof.

FIG. 5 is a partial sectional view of the electrical connector assembly 100 taken through the port flanks 124. The port flanks 124 are defined by the walls 108 of the cage member 102. The port flanks 124 extend between the front end 154 and the rear end 156. The port flanks 124 may be positioned above or below the port separators 130. The port flanks 124 extend along opposite sides 240, 242 of the shell 230 of the pluggable module 106. The channel walls 128 of the port flanks 124 may extend between the upper plate 136 of the lower port separator 132 and the lower plate 138 (shown in FIG. 6) of the upper port separator 130 (shown in FIG. 6) to divide the port flanks 124 into the individual channels 126. The channels 126 are open at the front end 154 and the rear end 156 to direct airflow through the cage member 102. Optionally, the channel walls 128 may extend the entire length between the front end 154 and the rear end 156. Optionally, the channels 126 may have uniform widths along lengths thereof. For example, in the illustrated embodiment, the channel walls 128 are oriented parallel to the side walls 120, 122; however other orientations are possible in alternative embodiments.

The port flanks 124 provide pathways for airflow along the pluggable module 106 and along the communication connector 104. The airflow is used for heat dissipation from the pluggable module 106 and/or the communication connector 104. Connector portions of the channels 126 pass between the communication connector 104 and the corresponding side walls 120, 122. Module portions of the channels 126 pass between the pluggable module 106 and the corresponding side walls 120, 122. In an exemplary embodiment, multiple channels 126 pass between the communication connector 104/pluggable module 106 and each side wall 120, 122. The channel walls 128 are in thermal communication with corresponding plates 136, 138 of the port separators 130, 132 to dissipate heat from the system as the air flows past the channel walls 128.

Figure 6:
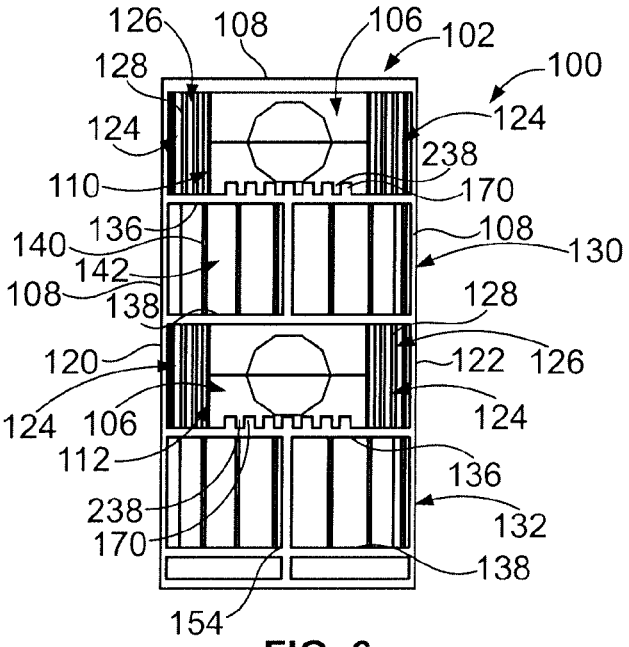
FIG. 6 is a front view of the electrical connector assembly showing the port separators and port flanks.

FIG. 6 is a front view of the electrical connector assembly 100. The pluggable modules 106 are shown loaded into the cage member 102. In an exemplary embodiment, the upper plate 136 of each port separator 130, 132 is configured to be in direct thermal contact or communication with the pluggable module 106 associated with the upper port 110 and the lower port 112, respectively. For example, the port separators 130, 132 have thermal interface features 170 that interface with corresponding thermal interface features 238 of the pluggable modules 106. In the illustrated embodiment, the thermal interface features 170 are fins with grooves defined therebetween that extend from the upper plates 136. The thermal interface features 238 are received in corresponding grooves such that the fins 170 are in direct thermal engagement with the thermal interface features 238. The lower plates 138 may be in direct thermal communication with corresponding pluggable modules 106 in other embodiments. Having the various walls and plates in thermal communication with the pluggable modules 106 allows efficient heat dissipation from the pluggable modules 106 as the heat may be transferred into any or all of the walls/plates, which may then be cooled by airflow across the walls/plates.

Other arrangements of the port separators 130, 132 are possible in alternative embodiments. For example, while the port separators 130, 132 are illustrated below the ports 110, 112, respectively, it is possible that the port separators 130, 132 are arranged above the ports 110, 112, respectively, in alternative embodiments. Optionally, only one port separator 130 may be provided between the ports 110, 112 without the lower port separator 132 in various embodiments. In other various embodiments, three port separators may be provided (for example, one above the upper port 110, one between the ports 110, 112 and one below the lower port 112). Other arrangements are possible when other ports are provided.

Optionally, in embodiments having multiple columns of ports 110, 112 (For example, 2×2, 2×4, etc.), the walls 108 of the cage member 102 may include a single divider wall between such ports 110, 112. The channels 126, 142 of the port flanks 124 and port separators 130 are located between the divider wall and the pluggable modules 106. Optionally, the cage member 102 may include a common upper wall and a common lower wall extending along all of the ports 110, 112.

During use, the pluggable modules 106 generate heat. It is desirable to remove the heat generated by the pluggable modules 106 so that the pluggable modules 106 can operate at higher performance levels. The heat generated by the pluggable modules 106 is thermally transferred to the cage member 102. Airflow along the walls 108 (for example, along the plates 136, 138, along the channel walls 128, along the channel walls 140, along the side walls 120, 122, and the like) cools the cage member 102, allowing more heat transfer from the pluggable modules 106. The airflow through the cage member 102 may be forced, such as by a fan or other component mounted proximate to the cage member 102. The airflow helps to reduce the temperature of the pluggable modules 106.

The thermal efficiency of the cage member 102, and thus the amount of heat transfer from a particular port 110, 112, is at least partially dependent on the amount of airflow through the cage member 102. Providing the channels 126 and the channels 142 between and around the ports, including the lower port 112, increases the amount of heat transfer from the pluggable modules 106. Optionally, the side walls 120, 122 may include openings or vents that allow airflow therethrough. The channel walls 128, 140 may include openings or vents to allow airflow between the channels 126, 142.

Direct heat transfer into the walls 108 of the cage member 102 allows efficient heat transfer from the pluggable module 106. The channel walls 140 are thermally coupled to the upper plates 136 to draw heat therefrom. Similarly, the channel walls 128 of the port flanks 124 are thermally coupled to the upper plates 136 to draw heat therefrom. The airflow through the channels 142 of the port separators 130, 132 and through the channels 126 of the port flanks 124 cools the cage member 102. The channels 126, 142 promote venting and/or cooling of the interior of the chassis where the electrical connector assembly 100 and printed circuit board are located. Optionally, the lower plate 138 of the upper port separator 130 is configured to be in direct thermal contact with the pluggable module 106 associated with the lower port 112 to dissipate heat from the pluggable module 106 in the lower port 112. The channel walls 140 are thermally coupled to the lower plate 138 to draw heat from the lower plate 138.

In some embodiments, the thermal vents created by the channels 126, 142 may encompass at least 50% of the surface area defined by the front end 154 of the cage member 102. In some embodiments, the thermal vents may encompass at least 75% or more of the surface area. For example, the port separators 130, 132 may have a larger width and/or height as compared to the ports 110, 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector assembly comprising:

a cage member having a plurality of walls defining an upper port and a lower port configured to receive pluggable modules therein, the plurality of walls defining side walls along sides of the upper and lower ports, the walls being manufactured from a metal material and providing electrical shielding for the upper port and the lower port; and the plurality of walls defining a port separator extending between the side walls along at least one of the upper port and the lower port, the port separator having an upper plate and a lower plate extending between the side walls of the cage member, the port separator having a plurality of channel walls extending between the upper plate and the lower plate to divide the port separator into a plurality of channels, the channels being open at a front and a rear of the port separator to direct airflow through the port separator.

2. The electrical connector assembly of claim 1, wherein the channels define thermal vents through the cage member to allow airflow entirely through the cage member.

3. The electrical connector assembly of claim 1, wherein the airflow in the channels cools the channel walls, the side walls, the upper plate and the lower plate by convection.

4. The electrical connector assembly of claim 1, wherein the channels have variable widths along lengths thereof defined between the front and the rear of the port separator.

5. The electrical connector assembly of claim 1, wherein portions of the channel walls are oriented parallel to the side walls.

6. The electrical connector assembly of claim 1, wherein each of the channels have air inlets and air outlets, the air inlets being provided at the front or the rear of the port separator, the air outlets being provided at the other of the front or the rear of the port separator.

7. The electrical connector assembly of claim 1, wherein at least one of the upper plate and the lower plate is configured to be in direct thermal communication with the pluggable module associated with one of the upper port or the lower port, the channel walls being thermally coupled to the upper plate and the lower plate.

8. The electrical connector assembly of claim 1, wherein the upper plate is configured to be in direct thermal communication with the pluggable module associated with the upper port, the lower plate is configured to be in direct thermal communication with the pluggable module associated with the lower port, the channel walls being thermally coupled to the upper plate and the lower plate.

9. The electrical connector assembly of claim 1, wherein the channel walls have convergent sections that change a spacing between the channel walls.

10. The electrical connector assembly of claim 1, further comprising a communication connector disposed within the cage member at a rear end of the cage member and positioned to mate with the pluggable modules when the pluggable modules are inserted into the upper and lower ports, portions of the channels passing between the communication connector and the corresponding side walls.

11. The electrical connector assembly of claim 10, wherein multiple channels pass between the communication connector and each side wall.

12. The electrical connector assembly of claim 10, wherein at least one of the channel walls defines a diverter wall to divert the airflow from a front of the communication connector to a side of the communication connector or vice versa.

13. The electrical connector assembly of claim 10, wherein the channel walls have module segments near the front of the port separator and connector segments near the rear of the port separator, the module segments being generally aligned with the pluggable module, the connector segments being generally aligned with the communication connector.

14. The electrical connector assembly of claim 10, wherein the plurality of walls define port flanks extending between the side walls and the corresponding upper port or the lower port, each port flank having a plurality of channel walls dividing the port flank into a plurality of channels being open at a front end of the cage member and being open at the rear end of the cage member to direct airflow through the cage member, portions of the channels of the port flanks passing between the communication connector and the corresponding side walls.

15. The electrical connector assembly of claim 1, wherein at least one of the upper plate and lower plate includes a plurality of thermal interface features configured to be in direct thermal communication with the adjacent pluggable module.

16. The electrical connector assembly of claim 1, wherein the port separator defines an upper port separator positioned between the upper port and the lower port, the plurality of walls defining a lower port separator below the lower port, the lower port separator having an upper plate and a lower plate extending between the side walls of the cage member, the lower port separator having a plurality of channel walls extending between the upper plate and the lower plate to divide the lower port separator into a plurality of channels, the channels being open at a front and a rear of the lower port separator to direct airflow through the lower port separator.

17. An electrical connector assembly comprising:

a cage member having a plurality of walls defining an upper port and a lower port configured to receive pluggable modules therein, the plurality of walls defining side walls along sides of the upper and lower ports, the walls being manufactured from a metal material and providing electrical shielding for the upper port and the lower port;

the plurality of walls defining a lower port separator extending between the side walls along the lower port, the lower port separator having an upper plate and a lower plate extending between the side walls of the cage member, the lower port separator having a plurality of channel walls extending between the upper plate and the lower plate to divide the lower port separator into a plurality of channels, the channels being open at a front and a rear of the lower port separator to direct airflow through the lower port separator; and the plurality of walls defining an upper port separator extending between the side walls along the upper port, the upper port separator having an upper plate and a lower plate extending between the side walls of the cage member, the upper port separator having a plurality of channel walls extending between the upper plate and the lower plate to divide the upper port separator into a plurality of channels, the channels being open at a front and a rear of the upper port separator to direct airflow through the upper port separator.

18. The electrical connector assembly of claim 17, further comprising a communication connector disposed within the cage member at a rear end of the cage member and positioned to mate with the pluggable modules when the pluggable modules are inserted into the upper and lower ports, portions of the channels passing between the communication connector and the corresponding side walls.

19. The electrical connector assembly of claim 18, wherein multiple channels pass between the communication connector and each side wall.

20. An electrical connector assembly comprising:

a cage member having a plurality of walls defining an upper port and a lower port configured to receive pluggable modules therein through a front end of the cage member, the plurality of walls defining side walls along sides of the upper and lower ports, the walls being manufactured from a metal material and providing electrical shielding for the upper port and the lower port;

a communication connector disposed within the cage member at a rear end of the cage member and positioned to mate with the pluggable modules when the pluggable modules are inserted into the upper and lower ports;

the plurality of walls defining a port separator extending between the side walls along at least one of the upper port and the lower port, the port separator having an upper plate and a lower plate extending between the side walls of the cage member, the port separator having a plurality of channel walls extending between the upper plate and the lower plate to divide the port separator into a plurality of channels, the channels being open at the front end and the rear end of the cage member to direct airflow through the cage member, portions of the channels passing between the communication connector and the corresponding side walls; and the plurality of walls defining port flanks extending between the side walls and the corresponding upper port or the lower port, each port flank having a plurality of channel walls dividing the port flank into a plurality of channels being open at the front end and the rear end of the cage member to direct airflow through the cage member with portions of the channels passing between the communication connector and the corresponding side walls.

* * * * *